United States Patent [19]

Thompson, II

[11] Patent Number: 4,674,771

[45] Date of Patent: Jun. 23, 1987

[54] LAMINATED PHARMACEUTICAL LABEL

[76] Inventor: Silas W. Thompson, II, 116 Church Rd., R.D. 1, Malvern, Pa. 19355

[21] Appl. No.: 861,348

[22] Filed: May 9, 1986

[51] Int. Cl.[4] ..... B41L 1/20

[52] U.S. Cl. ..... 282/8 R; 282/11.5 A; 283/81; 283/900; 283/901

[58] Field of Search ..... 282/8 R, 9 R, 11.5 R, 282/11.5 A; 283/81, 900, 901

[56] References Cited

U.S. PATENT DOCUMENTS

| | | | |
|---|---|---|---|
| 3,740,081 | 6/1972 | Whipperman | 283/81 X |
| 4,189,129 | 6/1979 | Lockhart | 283/900 X |
| 4,448,445 | 5/1984 | Chang et al. | 282/11.5 A X |
| 4,526,405 | 7/1985 | Hatlemer | 283/81 X |
| 4,576,399 | 3/1986 | White et al. | 283/901 X |
| 4,611,826 | 9/1986 | Breen | 282/8 R |
| 4,614,361 | 9/1986 | Foster | 282/8 R |

*Primary Examiner*—Paul A. Bell

*Attorney, Agent, or Firm*—Birch, Stewart, Kolasch & Birch

[57] ABSTRACT

A pressure-sensitive pharmaceutical label which cannot be removed with steam or water from a container once the label is applied, the label incorporating a combination of an image-producing self-contained carbonless pressure-sensitive label with an overlaminate having an opaque design on a portion of the surface thereof, such that any information subsequently printed on the overlaminated label will be obscured from view at the position having an opaque design.

20 Claims, 2 Drawing Figures

LAMINATED PHARMACEUTICAL LABEL

BACKGROUND OF THE INVENTION

The present invention relates to a pressure-sensitive pharmaceutical label which cannot be removed by steam or water from a container once the label is applied. More specifically, the present invention incorporates the combination of an image-producing self-contained carbonless pressure-sensitive label with an overlaminate having an opaque design on a portion of the surface thereof such that any information subsequently printed on the overlaminated label will be obscured from view at the portion having an opaque design.

Pressure-sensitive labels are commonly used in the pharmaceutical industry for labeling containers of drugs with patient address labels, and as a convenient means for a Doctor or Pharmacist to insert relevant user information into a notebook or the like. When using a label in, for instance, an experimental environment, the professional may have reasons for keeping specific information related to the drug or the patient a secret. Other information should always be available and may, therefore, be kept non-secret. Although the label of the present invention is adaptable to many environments, this is one exemplary use.

Further, in such an experimental environment, as in any normal handling of containers, there may be moisture in the air or on the user's hands, which may dissolve a coating that has been applied to a label, thereby revealing information which was intended to be kept secret.

An example of such a label having water-soluble paper which is washed away to reveal secret information appears in U.S. Pat. No. 3,740,081 to Whipperman issued June 19, 1973.

SUMMARY OF THE INVENTION

Accordingly, it is a primary object of the present invention to provide a label which obscures from view material printed on at least a portion of the label.

It is another object of the present invention to provide a label which eliminates the possibility of visual recognition of the material printed on the label when viewed from the rear of the label.

It is a further object of the present invention to provide a label as described above which is mass-produced on a continuous sheet.

It is still a further object of the present invention to provide a label wherein the surface portion of the label which eliminates the possibility of visual recognition of the material printed on the label is impervious to water but soluble in alcohol.

The objects of the present invention are fulfilled by providing a label comprising backing paper having first and second major surfaces, at least one of the major surfaces having a release coating thereon, a first permanent, pressure-sensitive adhesive layer formed on a selected portion of the release coating, image-producing self-contained carbonless paper (hereinafter referred to as carbonless paper) contiguous to the first permanent pressure-sensitive adhesive layer, the carbonless paper having first and second major surfaces, a second permanent, pressure-sensitive adhesive layer covering the carbonless paper, clear laminate means applied to the second permanent pressure-sensitive adhesive layer for protecting the carbonless paper, and an opaque coating on the surface of the laminate means for obscuring the visibility of any information contained on a selected portion of the carbonless paper.

The label further includes an information overlay sheet for receiving pressure-applied indicia to be transferred to the carbonless paper by pressure through the laminate means, the information overlay sheet being disposed on top of the laminate means.

A plurality of labels may be formed on a continuous backing sheet, the continuous backing sheet being die cut to facilitate removal of a single one of a plurality of labels therefrom. The label further includes perforations for sectioning the label into a plurality of parts, at least one of the plurality of parts containing the opaque coating for obscuring the visibility of any information contained on the carbonless paper.

In a preferred embodiment of the present invention, the first pressure-sensitive adhesive layer contains either an opaque dye, or the carbonless paper is coated with an opaque ink on the first major surface thereof. Additionally, the opaque coating for obscuring at least a portion of the surface of the laminate means is an alcohol-solvent-based ink design, such as a Chinese character design. A continuous backing sheet and cover sheet may be marginally punched for use as computer paper.

The present invention is useful in connection with the testing and labeling of experimental drugs in a laboratory situation. Specifically, the unique design of the present label is such that secret information, such as the name of the drug being tested, can be placed anywhere on the label on which Chinese characters have been formed to obscure the information from the view of either the administrator or the patient. This is a combination or formulation of materials that can be used in such a fashion that every label can contain completely different information and has secret and revealable information printed after the lamination and application of an opaque design has taken place. Once a surface sheet of paper on which information has been printed is removed, the secret information is invisible unless the opaque ink design is removed by an alcohol-based solvent.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawing which is given by way of illustration only, and thus is not limitative of the present invention, and wherein.

DETAILED DESCRIPTION OF PREFERRED EMBODIMENTS

Figure 1:
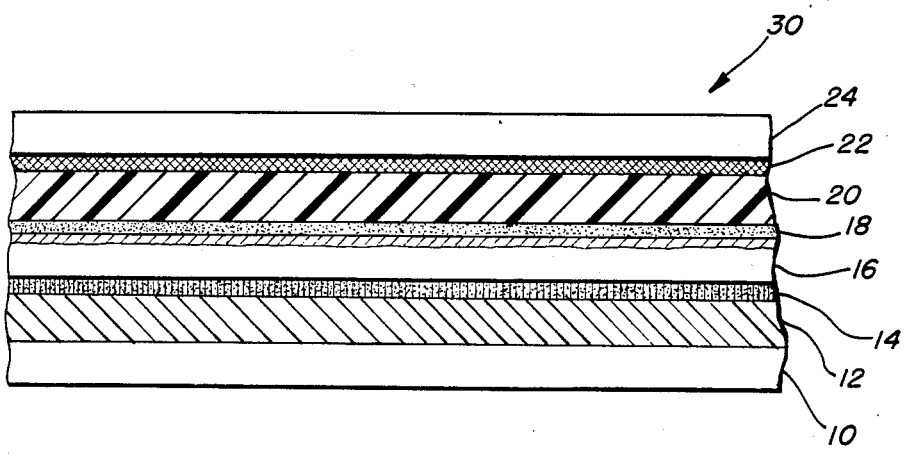
FIG. 1 is cross sectional view of the laminated pharmaceutical label.

Referring to FIG. 1, there is illustrated a laminated pharmaceutical label 30 in a cross sectional view. The entire label may be made on marginally punched computer paper for use with a computer printer, if desired. The first layer 10 of the label is an endless sheet of backing paper. Also, the backing paper may have a plurality of die cut areas which correspond to and remain with a label when the label is removed from the backing and applied to a container or other surface. Located at 12 is a release coating, such as a silicone, applied to one or more major surface of the backing sheet so that the label to be applied to a container or the like may be easily peeled from the backing sheet without tearing or damaging the label. The next layer 14 is of a pressure-sensitive adhesive which is permanent in nature. The adhesive may contain a dye which will prevent a user from viewing printed information from the rear of the label when the label is applied to a see-through object, such as a bottle. Formed on top of layer 14 is carbonless paper which is substantially coextensive with the label. The carbonless paper is die cut to correspond to the die cut of the backing paper so that, when the carbonless paper is removed along with its backing, a die cut matrix will remain. The carbonless paper 16 may, either in addition to or alternatively, contain an ink coating on the rear surface thereof which serves the same purpose as the dye formed in the pressure-sensitive adhesive layer 14, which is to prevent the user of the label from viewing any material printed on the front surface thereof by reading the rear of the label. Layer 18 consists of a clear pressure-sensitive adhesive similar to that of layer 14, but having no dye or tint color therein. A clear laminate 20, such as a clear acetate, plastic or paper film, is formed over either a portion of the carbonless paper label or over the entire portion of the carbonless paper 16. Applied to the surface of the clear laminate 20 is an alcohol-solvent-based ink, or tint, which covers either a portion of the label or the entire label having an overlaminate thereon. The ink design is preferably of a Chinese-character-type design which effectively conceals the printing of any material thereon from visual recognition by a viewer. Additionally, a continuous, marginally punched surface paper 24 may be optionally formed over the entire label construction by crimping, or gluing to the release coated backing sheet.

Figure 2:
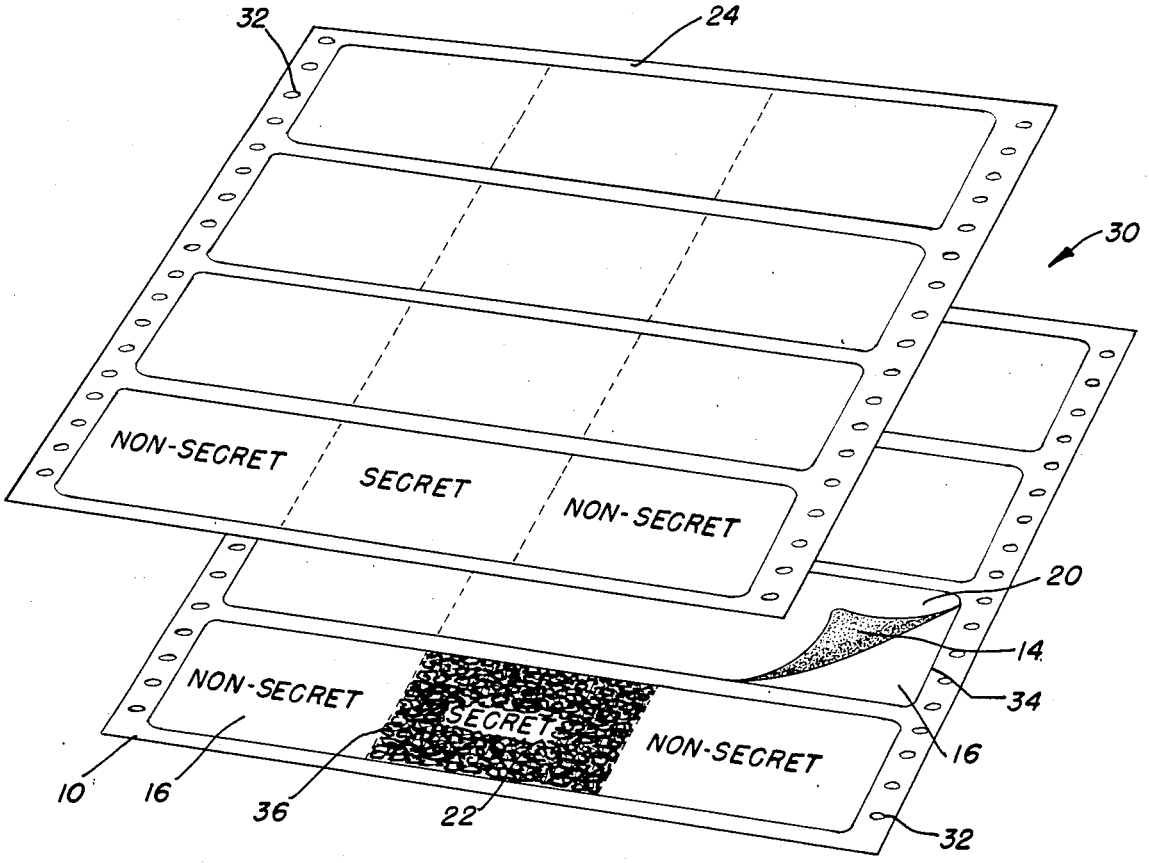
FIG. 2 is an exploded view of the laminated pharmaceutical label.

FIG. 2 is an exploded view of the laminated pharmaceutical label 30. The backing paper 10 has a release coating thereon (not shown) which is in a superimposed relationship with the optional surface paper 24. Both the backing paper 10 and the surface paper 24 have a plurality of marginally punched openings running along the outer edges thereof in order to facilitate use with a computer printer. The self-contained carbonless paper 16 is adhered to the release coated backing paper 10 by a dyed pressure-sensitive adhesive 14. Each of the labels 16 positioned on the backing paper 10 are perforated as at 36 so that secret and non-secret information may be separated for use in different locations. Located on the self-contained carbonless paper is the alcohol-solvent-based ink at 22 which utilizes a design such as a Chinese character design. An alcohol-solvent-based ink is formed over a clear acetate or plastic 20 which may be formed over the entire surface of the self-contained carbonless paper 16 or over only a single section defined by the perforation boundaries 36. Each label of self-contained carbonless paper is positioned on the backing paper 10 such that the label may be removed along die cut portions 34 formed in the backing paper 10. The surface sheet 24 has printed thereon a plurality of outlines conforming to the labels superimposed therebelow on backing sheet 10 so that the user may optionally print the secret and non-secret information across the surface of paper 24, all of which information will be visible to the user until the surface paper 24 is removed from the backing sheet containing the labels.

The label construction 30, therefore, results in a pressure-sensitive label which cannot be removed by steam or water from a container once the label is applied thereto. Further, information, such as that relating to patient name, drug number, or emergency information related to the test drug or to the patient, may be imprinted on either the surface computer paper 24 or, optionally, across the overlaminated label itself. Once the surface paper is removed, all that remains is a label with printed indicia thereon, at least a portion of which is obscured from view or secret to the user due to the Chinese characters. When the label is peeled from the backing sheet and applied to a container, the secret information is also not viewable by the user due to the ink contained in the first permanent adhesive layer and/or an ink tint to the rear of the self-contained carbonless paper. The secret information section can be placed anywhere on a label in which the manufacturer is instructed to imprint the Chinese character design or tint. A unique part of the entire construction is the combination of the opaquely printed, clear material and the carbonless paper having an opaque ink, coating or opaque dyed adhesive on the rear surface thereof. All secret and revealable pertinent information is printed after the label has been laminated and the alcohol-soluble-Chinese-character ink design is applied thereto. Therefore, information above and below the lamination 20 are identical. The entire label or any portion thereof can be overlaminated.

The secret information hidden by the Chinese-character-ink design cannot be revealed unless the printed design is swabbed with alcohol. This is a substantial advantage over other labels in the art which may have water-soluble ink on the labels. An alcohol solvent-based ink design will not deteriorate due to humid or moisture-laden conditions, nor the inadvertent handling of the label by a person with wet hands, or any other myriad of incidents which would allow the label to come in contact with moisture. Further, once swabbed, it is evident that the label has been tampered with and it cannot be returned to its original state. Additionally, if the laminate portion 20 is tampered with, it will tear the label or otherwise destroy the laminate.

Printed information on the cover sheet and the surface of the carbonless paper is achieved by applying pressure, such as hand-writing, printing, typing, or computer-generated information on the surface of the cover paper or, alternatively, on the surface of the carbonless paper having a laminate applied thereto such that encapsulated material of the carbonless paper is broken, causing an image to be formed. The actual pressure need not come in direct contact with the label paper, but, as mentioned above, may be applied to the cover sheet 24.

For convenience, the label 30 is perforated in one or more locations so that a portion of the label may be applied to a container or the like and the remainder of the label may be placed on a case study or other document.

Construction of the laminated pharmaceutical label is achieved by the following steps. The manufacture begins production with a roll of pressure-sensitive, carbonless paper which has an adhesive-release agent and backing paper laminated together.

First, a design, such as that of a Chinese-character-ink design or a solid tint, is imprinted on the clear acetate or other clear material. The imprinting of a design is preferable because the use of certain types of solid tints are ineffective in preventing the viewing of an imprint from the rear of the label due to the benefit of light reflection. Printing is done on a solid opaque section or by using purposely indistinguishable printed characters with alcohol-soluble inks. The clear acetate laminate is utilized because the material is impervious to water, is difficult to remove in one piece, and can be easily printed with the alcohol-soluble ink. The alcohol-soluble ink can be removed by applying an alcohol-based solvent thereto without destroying printed information formed on the carbonless paper located beneath the laminate surface.

Next, the acetate containing the indistinguishable printed Chinese characters with alcohol-soluble ink is laminated to the carbonless paper. The clear dye acetate may be laminated on either the entire label or on a portion of the label, depending on the ultimate use thereof.

Further, in the event that the consumer desires to use a computer-printed label, it is necessary to punch holes in the backing sheet so that it may later be used in conjunction with a computer printer or other automatic feed instrument. Absent the step of punching holes in the backing sheet, the finished labels will be fanfolded at the final step and the process for packaging the labels in final container form can be adapted to the specific method required by the user.

Following the lamination process, the label is die cut using either steel or a flexographic die. The label can be cut to any size or shape, depending upon the specifications of the customer.

Next, all waste materials commonly called the "matrix" between the labels is removed.

It should be noted that a control sheet may be applied after the lamination, cutting and cleaning processes have been completed which will allow the user to imprint secret and non-secret information on the control sheet for recordkeeping purposes in the following fashion. First, the secret information would be typed on whatever control sheet was attached to the laminated label with the label portion being underneath the control sheet. Thus, the control sheet will contain the secret information, while the label will not until the indistinguishable printed characters or other tint is removed by applying an alcohol-based solvent to the surface thereof. If no control sheet is necessary, none need be applied.

The finish on the label should be a matte finish as opposed to a gloss or standard finish. If a gloss or standard finish is utilized and a computer printer is used on a label, information would be smeared or smudged and obliterate the viewable information.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A label comprising: backing paper having first and second major surfaces, at least one of said major surfaces having a release coating thereon;

a first permanent, pressure-sensitive adhesive layer formed on a selected portion of said release coating;

carbonless paper contiguous to said first permanent pressure-sensitive adhesive layer, said carbonless paper having first and second major surfaces;

a second clear permanent, pressure-sensitive adhesive layer covering said carbonless paper;

clear laminate means applied to said second permanent pressure-sensitive adhesive layer for protecting said carbonless paper; and an opaque coating on the surface of said laminate means for obscuring the visibility of any information contained on a selected portion of said carbonless paper.

2. The label according to claim 1, wherein said clear laminate means is a clear polyester film over at least a portion of said carbonless paper.

3. The label according to claim 1, wherein said opaque coating for obscuring at least a portion of the surface of said laminate means is an alcohol solvent-based ink design.

4. The label according to claim 1, wherein said opaque coating for obscuring at least a portion of the surface of said laminate means is an alcohol solvent-based tint.

5. The label according to claim 1, further including an information overlay sheet for receiving pressure-applied indicia to be transferred to said carbonless paper by said pressure through said laminate means, said information overlay sheet being disposed on top of said laminate means.

6. The label according to claim 5, wherein said continuous plain surface sheet of paper is marginally punched for use as computer paper.

7. The label according to claim 5, wherein said first pressure-sensitive adhesive layer contains an opaque dye.

8. The label according to claim 5, wherein said carbonless paper is coated with an opaque ink on the first major surface thereof.

9. The label according to claim 5, wherein said clear laminate means is a clear acetate over at least a portion of said carbonless paper.

10. The label according to claim 1, wherein a plurality of said labels are formed on a continuous backing sheet, said continuous backing sheet being die cut to facilitate removal of a single one of said plurality of labels therefrom.

11. The label according to claim 10, wherein said continuous backing sheet is marginally punched for use as computer paper.

12. The label according to claim 1, further including perforations for sectioning said label into a plurality of parts, at least one of said plurality of parts containing said opaque coating for obscuring the visibility of any information contained on said carbonless paper.

13. The label according to claim 1, wherein said first pressure-sensitive adhesive layer contains an opaque dye.

14. The label according to claim 1, wherein said carbonless paper is coated with an opaque ink on the first major surface thereof.

15. The label according to claim 1, wherein said clear laminate means is a clear acetate over at least a portion of said carbonless paper.

16. The label according to claim 1, wherein said clear laminate means is a clear polyester film over at least a portion of said carbonless paper.

17. The label according to claim 1, wherein said opaque coating for obscuring at least a portion of the surface of said laminate means is an alcohol solvent-based ink design.

18. The label according to claim 17, wherein said ink design is a Chinese character design.

19. The label according to claim 1, wherein said opaque coating for obscuring at least a portion of the surface of said laminate means is an alcohol solvent-based tint.

20. A pharmaceutical label for use in labeling products which require selected information to be kept a secret from the user except in the case of an emergency, comprising:

backing paper having first and second major surfaces, at least one of said major surfaces having a release coating thereon;

a first permanent, pressure-sensitive adhesive layer formed on a selected portion of said release coating, said first permanent pressure-sensitive adhesive layer containing an opaque die;

carbonless paper contiguous to said first permanent pressure-sensitive adhesive layer, said carbonless paper having first and second major surfaces;

a second clear permanent, pressure-sensitive adhesive layer covering said carbonless paper;

clear laminate means applied to said second clear permanent, pressure-sensitivie adhesive layer for protecting said carbonless paper from moisture damage, tampering and the like; and an opaque Chinese-character-ink coating on the surface of said laminate means for obscuring the visibility of any information contained in a selected portion of said carbonless paper;

the portion of said pharmaceutical label having said opaque coating thereon being able to conceal secret information when viewed from either the front or rear surface of said label.

* * * * *